US010525458B2

(12) United States Patent
Ono et al.

(10) Patent No.: US 10,525,458 B2
(45) Date of Patent: Jan. 7, 2020

(54) CLEAN AIR DEVICE AND AIR CLEANING UNIT INSPECTING METHOD

(71) Applicant: Hitachi Industrial Equipment Systems Co., Ltd., Chiyoda-ku, Tokyo (JP)

(72) Inventors: Keiichi Ono, Tainai (JP); Hirotoshi Sato, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 183 days.

(21) Appl. No.: 15/506,274

(22) PCT Filed: Nov. 17, 2014

(86) PCT No.: PCT/JP2014/080309
§ 371 (c)(1),
(2) Date: Feb. 24, 2017

(87) PCT Pub. No.: WO2016/079777
PCT Pub. Date: May 26, 2016

(65) Prior Publication Data

US 2018/0214861 A1 Aug. 2, 2018

(51) Int. Cl.
*B01L 1/04* (2006.01)
*F24F 3/16* (2006.01)

(52) U.S. Cl.
CPC ..... *B01L 1/04* (2013.01); *F24F 3/161* (2013.01); *B01L 2200/082* (2013.01);
(Continued)

(58) Field of Classification Search
CPC ..... B01L 1/04; B01L 1/20; B01L 2200/082; B01L 2200/141; B01L 2300/0063; B01L 2300/0681; B01L 2300/10; F24F 3/161
(Continued)

(56) References Cited

U.S. PATENT DOCUMENTS 4,927,438 A * 5/1990 Mears ..... F24F 3/1607 454/56
5,410,922 A * 5/1995 Katahira ..... B08B 15/00 108/43

(Continued)

FOREIGN PATENT DOCUMENTS

CN 1576738 A 2/2005
CN 201783501 U 4/2011

(Continued)

OTHER PUBLICATIONS

International Search Report (PCT/ISA/210) issued in PCT Application No. PCT/JP2014/080309 dated Feb. 17, 2015 with English translation (5 pages).

(Continued)

*Primary Examiner* — Edelmira Bosques
*Assistant Examiner* — Dana K Tighe
(74) *Attorney, Agent, or Firm* — Crowell & Moring LLP

(57) ABSTRACT

With respect to a clean air device, in order to provide a device structure and an air cleaning unit inspecting method capable of supplying clean air through a filter and also capable of measuring the amount of dust in a workroom space in which blown air forms a laminar flow such that an increase in the amount of dust can be accurately detected, the clean air device comprises an air cleaning unit, a rectifying unit arranged downstream of the air cleaning unit configured to rectify air blown from the air cleaning unit and form a laminar flow, and a workroom arranged downstream of the rectifying unit, wherein at least one suction port is provided on a wall surface in a space formed between the air cleaning unit and the rectifying unit, configured to draw out the air in the space to an exterior.

6 Claims, 6 Drawing Sheets

(52) U.S. Cl.
CPC ... *B01L 2200/141* (2013.01); *B01L 2300/045* (2013.01); *B01L 2300/0663* (2013.01); *B01L 2300/0681* (2013.01); *B01L 2300/10* (2013.01)

(58) Field of Classification Search
USPC ..... 454/187
See application file for complete search history.

(56) References Cited

U.S. PATENT DOCUMENTS

| | | | | |
|---|---|---|---|---|
| 5,665,128 | A * | 9/1997 | Peters | B01D 46/10 454/61 |
| 6,632,260 | B1 * | 10/2003 | Siemers | B01D 46/0013 454/184 |
| 7,090,709 | B2 * | 8/2006 | Ono | B01L 1/04 454/187 |
| 7,204,751 | B2 * | 4/2007 | Jang | B01D 53/0446 454/187 |
| 2004/0107679 | A1 * | 6/2004 | Ono | B01L 1/04 55/385.2 |
| 2005/0048899 | A1 | 3/2005 | Anezaki et al. | |
| 2013/0061567 | A1 | 3/2013 | Kawasaki et al. | |

FOREIGN PATENT DOCUMENTS

| | | | |
|---|---|---|---|
| CN | 102090979 | A | 6/2011 |
| CN | 102946970 | A | 2/2013 |
| CN | 203075964 | U | 7/2013 |
| EP | 1 147 826 | A2 | 10/2001 |
| GB | 1 338 318 | A | 11/1973 |
| JP | 53-48199 | U | 4/1978 |
| JP | 1-107851 | A | 4/1989 |
| JP | 3-275150 | A | 12/1991 |
| JP | 6-121935 | A | 5/1994 |
| JP | 7-243696 | A | 9/1995 |
| JP | 9-250802 | A | 9/1997 |
| JP | 2001-108606 | A | 4/2001 |
| JP | 2005-218925 | A | 8/2005 |
| JP | 2005-279575 | A | 10/2005 |
| JP | 2008-275266 | A | 11/2008 |
| JP | 2011-202945 | A | 10/2011 |
| JP | 2012-255761 | A | 12/2012 |

OTHER PUBLICATIONS

Japanese-language Written Opinion (PCT/ISA/237) issued in PCT Application No. PCT/JP2014/080309 dated Feb. 17, 2015 (3 pages).
Japanese-language Office Action issued in counterpart Japanese Application No. 2016-559699 dated Oct. 10, 2017 (four pages).
Chinese-language Office Action issued in counterpart Chinese Application No. 201480081768.4 dated Oct. 8, 2018 (nine pages).

* cited by examiner

CROSS-SECTION AA of FIG. 4B

CLEAN AIR DEVICE AND AIR CLEANING UNIT INSPECTING METHOD

TECHNICAL FIELD

The present invention relates to a device (clean air device) providing a clean space as an environment for fabricating sterilized medicine, biological products and so on.

BACKGROUND ART

In the environment for fabricating sterilized medicine, biological products and the like, the products are fabricated in a space that maintains a certain level of cleanliness to reduce contamination risks of the medical products and the like. A clean air device is an example of the device that provides such space.

The clean air device sends air using an air blowing means, and the air is passed through an HEPA filter (High Efficiency Particulate Air Filter) serving as an air cleaning unit to remove the dust contained in the air before being supplied to a predetermined space. In such environment for fabricating medical products and the like, the amount of floating dust in a space must be managed. The reason for this is that in a state where the amount of floating dust exceeds a certain number, there is a probability that that the medical product is contaminated, and the fabrication of the medical products is hindered.

Japanese Unexamined Patent Application Publication No. 2012-255761 (Patent Literature 1) discloses a background art of the present technical field. Patent Literature 1 discloses a method of monitoring the number of floating dust within a workroom, including supplying cleaned air from an upper portion of a workroom in which a fan filter unit (FFU) is arranged, and monitoring an amount of floating dust within the workroom, wherein a suction port is provided on a wall surface of a workroom, a sampling tube is inserted to the suction port, and a dust measuring device is connected to a tip of the sampling tube.

CITATION LIST

Patent Literature

[PTL 1] Japanese Unexamined Patent Application No. 2012-255761

SUMMARY OF INVENTION

Technical Problem

According to the method of managing the amount of floating dust of the prior art, a suction port is provided to the wall surface of the workroom, and the amount of dust is counted by taking the air within the workroom into the dust measuring device by a sampling tube inserted to the suction port. According to the prior art technique, a fan filter unit (FFU) smaller than an area of a ceiling surface of a laboratory is provided, and cleaned air is blown therethrough, so that the air within the workroom creates a turbulent flow in which the air is moved not only in a vertical direction but also in a horizontal direction. In the drawing of Patent Literature 1, movement of air in the horizontal direction is illustrated, so that it can be recognized that the air flow within the workroom is a turbulent flow.

In general, a light scattering type airborne particle counter (particle counter) or a relative densitometer (photometer) and the like is adopted as a dust measuring device. In ISO, the cleanliness of air is represented by the number of dust contained in a unit volume, so that the light scattering type airborne particle counter (particle counter) that counts the amount of dust is often used as the measuring device. In order to count the dust in the workroom using the light scattering type airborne particle counter (particle counter), a certain amount of air per unit time is drawn into the particle counter through the sampling tube from inside the workroom. Then, the dust contained in the drawn air is counted and integrated to correspond to a predetermined amount of air, according to which the amount of dust contained in a unit volume can be counted.

The location where dust is taken in is close to the entrance of the sampling tube. In a workroom adopting a turbulent flow system as taught in Patent Literature 1, the air within the workroom moves irregularly, so that the amount of dust at the suction port having the sampling tube inserted and the amount of dust at a location distant from the suction port are approximately the same amount of dust within the range moved by the turbulent flow.

In an environment for fabricating a medical product and the like, it is necessary not only to manage the amount of floating dust within the space, but also to create a laminar flow in one direction by the cleaned air blown into the workroom. In the case of a laminar flow, air is not moved to a direction at a right angle with respect to the air flow direction, so that the dust at a certain position within the workroom is prevented from spreading to other positions. In order for the dust to move in a right angle with respect to the air flow direction in a space where laminar flow exists, it is only possible to assume spreading diffusion caused by Brownian motion of the dust itself.

One cause of the increase of amount of dust within the workroom is the occurrence of dust generated by the operator himself/herself operating within the workroom, and a leakage of dust (leak) from the HEPA filter through which cleaned air is supplied. If the air flow within the workroom is a laminar flow in one direction, the dust having occurred during operation is flown leeward from an operation zone and discharged from the operation zone. In contrast, in a state where leakage of dust has occurred from the HEPA filter, the HEPA filter is positioned at a most windward position of the workroom serving as a cleaned space, so that the dust is flown to the workroom positioned on the leeward side. Similarly, if a laminar flow is created in the workroom, the dust generated upstream is flown in one direction without spreading beyond a diffusion level, and discharged from the workroom.

Since the dust measuring device counts dust from the air taken in through the sampling tube, in the space where laminar flow exists, there is a probability that leakage of dust (leak) of the HEPA filter is overlooked if no dust passes near the entrance of the sampling tube.

The object of the present invention is to provide a configuration of a clean air device and an inspecting method in a clean air device including a safety cabinet where cleaned air is supplied through a filter and blown air creates a laminar flow in a workroom, wherein an amount of dust within a space is measured and increase of dust is discovered reliably.

Solution to Problem

In order to solve the problems described above, the present invention provides a clean air device including an air cleaning unit, a rectifying unit arranged downstream of the air cleaning unit configured to rectify air blown from the air cleaning unit and form a laminar flow, and a workroom arranged downstream of the rectifying unit, wherein at least one suction port is provided on a wall surface in a space formed between the air cleaning unit and the rectifying unit, configured to draw out the air in the space to an exterior.

Advantageous Effects of Invention

The present invention provides a device (clean air device) and an air cleaning unit inspecting method capable of measuring the amount of dust within a space reliably and capable of discovering the increase of dust within a workroom in which a cleaned air supplied through a filter forms a laminar flow.

DESCRIPTION OF EMBODIMENTS

Now, first through fourth embodiments of the present invention will be described with reference to FIGS. 1 through 8.

First Embodiment

Figure 1A:
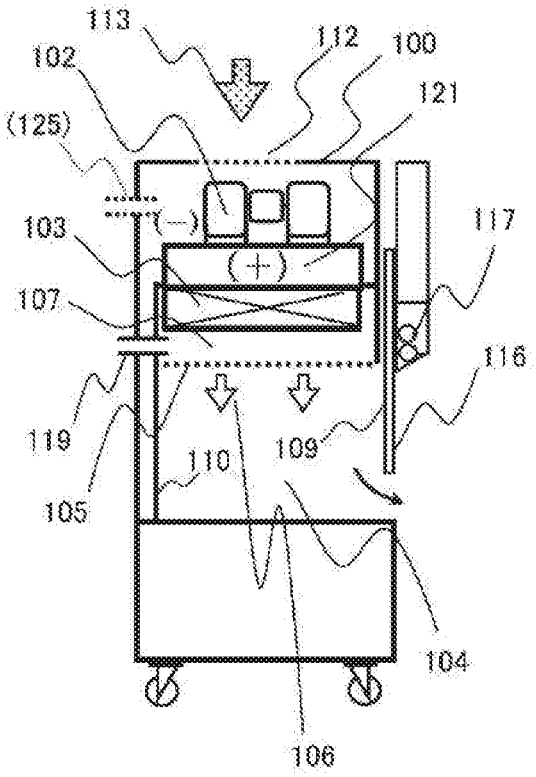
FIG. 1A illustrates an example of a cross-sectional side view of a clean work station according to a first embodiment of the present invention.
Figure 1B:
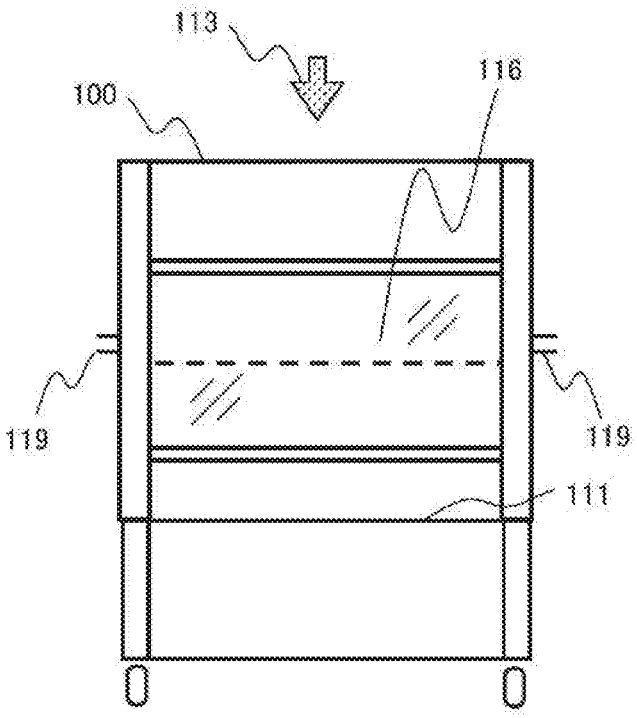
FIG. 1B illustrates an example of an external front view of the clean work station according to the first embodiment of the present invention.
Figure 2:
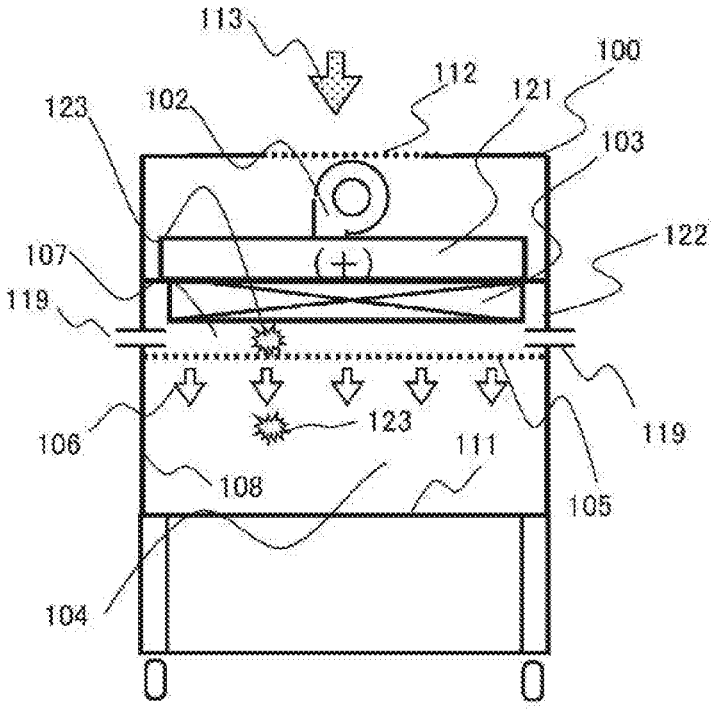
FIG. 2 illustrates an example of a cross-sectional view of the clean work station according to the first embodiment of the present invention.

FIG. 1 illustrates a configuration of a clean work station 100 according to a first embodiment, wherein FIG. 1A is a configuration example of a cross-sectional side view of the work station, and FIG. 1B is an example of an external front view thereof. FIG. 2 is a configuration example of a cross-sectional front view of the clean work station 100.

In the specification, a clean air device refers to a concept including a clean work station according for example to FIG. 1, a safety cabinet (class II cabinet for biohazard countermeasure) according for example to FIG. 7, cabinets of other classes for biohazard countermeasure, and a clean room, which provides clean air inside a workbench, and in which cleaned air is flown into a worktable which is protected from intrusion of saprophyte from an exterior of the device, or an isolator, or an area formed by enclosing a part of an already enclosed workbench.

The clean work station and the safety cabinet differ in the relative relationship of atmospheric pressures between the exterior and the interior of the device. The atmospheric pressure of the interior of the clean work station is set high (set to positive pressure) so as to prevent foreign matter from mixing in from the exterior of the device, and to push the air out to the exterior. On the other hand, the interior of the safety cabinet is maintained to negative pressure so as to prevent leakage of internal samples as a countermeasure for confining biohazards, and cleaned air is discharged through a filter.

An air blower 102 is arranged in an interior of the clean work station 100, and air is taken into the clean work station 100 through an inlet port 112 formed on the clean work station 100. Further, the air blower 102 is connected to a pressurization chamber 121 and pressurizes the chamber. The pressurization chamber 121 is connected to an HEPA filter 103 and pressurized by the air blower 102 so that clean air is supplied. The air blower 102 may be arranged outside the clean work station 100.

A rectifier 105 is arranged on a leeward side of the HEPA filter 103. An upstream space 107 of the rectifier is a space surrounded by the HEPA filter 103 disposed on the air intake side and the rectifier 105 disposed on the air discharge side, with the sides other than the HEPA filter 103 and the rectifier 105 sealed. The upstream space 107 of the rectifier is pressurized by the clean air blowing out from the HEPA filter 103, and air having uniform wind speed 106 is blown out through the whole surface of the rectifier 105. Since air is moved in a direction parallel to the rectifier 105 on a windward side of the rectifier 105 so as to uniformize the blown air 106 from the rectifier 105, the upstream space 107 of the rectifier becomes a turbulent flow zone.

The blown air 106 from the rectifier 105 is supplied to a workspace 104. The workspace 104 is surrounded by a side wall surface 108 of the workspace (FIG. 2), a front surface 109 of the workspace (FIG. 1A), and a rear wall surface 110 of the workspace (FIG. 1A). A laminar flow is formed by the surrounded space and the blown air 106 from the rectifier 105. Regarding the uniformity of the blowout wind speed of the blown air 106 for forming the laminar flow, a variation of wind speeds at the respective measurement positions is within a range of approximately plus or minus 20% with respect to an overall mean wind speed value.

A front face shutter 116 is arranged at a front face of the workspace 104. An operator puts his/her arm into the workspace 104 through an opening formed below the front face shutter 116, and performs operation while visually confirming the workspace 104 through the front face shutter 116. An operable illumination is maintained in the workspace 104 by an illuminating lamp 117. The air within the workspace 104 is discharged through the opening below the front face shutter 116, and the clean blown air 106 is always supplied into the workspace 104. Further, in some cases, air is sucked in instead of being discharged through the opening below the front face shutter 116, as described in a fourth embodiment described later.

A suction port 119 is formed on a wall surface on the upstream space 107 of the rectifier. The suction port 119 communicates the upstream space 107 of the rectifier with the exterior space of the clean work station 100. If the suction port 119 is not used, a lid (not shown) is used to block the opening from either the exterior side of the clean work station 100 or from the rectifier side of the upstream space 107. The suction port 119 can be attached to the upstream space 107 of the rectifier from the rectifier 105.

The flow of air ill be confirmed again with reference to the cross-sectional front view of FIG. 2.

The cleaned air blowing out from the HEPA filter 103 enters the upstream space 107 of the rectifier, rectified by the rectifier 105, and supplied as blown air 106 to the workspace 104. The blown air 106 forms a laminar flow within the workroom with substantially the same blow wind speed from the right side to the left side of the workspace 104. Further, one or more suction ports 119 are formed on the side wall surface of the upstream space 107 of the rectifier.

The upstream space 107 of the rectifier is an enclosed space with the blow-out side of the HEPA filter 103 set upstream and the rectifier 105 set downstream. The workspace 104 is also an enclosed space with the rectifier 105 set upstream and an opening below the front face shutter 116 set downstream. If dust is not newly generated in the workspace 104, the dust not caught in the HEPA filter 103 will be supplied to the workspace 104. In other words, there is a constant movement of air, and the total amount of dust per unit volume within the upstream space 107 of the rectifier and the total amount of dust per unit volume within the workspace 104 are the same.

Therefore, the issue is whether air can be taken in appropriately, in order to perform appropriate evaluation by a suction type dust measuring device, such as a particle counter. Dust 123 within the workspace 104 is carried by the air flow and moved from windward to leeward. The air flow within the workspace 104 is a laminar flow, so that there is some movement by diffusion, but the dust will not move in a direction orthogonal to the direction of the air flow. In order to measure the amount of dust in the workspace 104, if the air sampling location is distant from the location where dust 123 is flown, some dust 123 may be leaked from the sampling. This phenomenon is recognized significantly in a case where a measurement result of cleanliness of the workspace 104 having a small amount of dust is classified as ISO class 5 or lower (such as class 5 or class 4). In ISO, the cleanliness is classified into ranks based on the amount of dust per unit volume. If a turbulent flow is created in the workspace 104, a cleanliness of ISO class 5 or lower is difficult to realize. In order to realize a cleanliness of ISO class 5 or lower, it is necessary that the blown air 106 is clean, and that the air flow system realizes a laminar flow in one direction.

In the upstream space 107 of the rectifier, the dust 123 is moved in a direction parallel to the blow out surface of the rectifier 105. This is because the air is moved in the direction parallel to the rectifier 105 in the windward side of the rectifier 105, such that the blown air 106 from the rectifier 105 is made as uniform as possible. If the distance between the blow out surface of the HEPA filter 103 and the rectifier 105 is unlimited, in a state where leakage of dust (leak) occurs to a portion of the HEPA filter 103, the air is sufficiently diffused before reaching the rectifier 105, such that the dust 123 blown out from the rectifier 105 is uniformly blown into the workspace 104, but actually, it is impossible that the distance is unlimited. The wind speed passing the rectifier 105 is approximately 0.3 m/s to 0.6 m/s, so that in a device having a size that can be handled by human hand, the air passes through the upstream space 107 of the rectifier in no time, and the dust 123 caused by leakage of dust (leak) is blown into the workspace 104 before it is diffused to the whole area of the rectifier 105. However, the air blown out from the HEPA filter 103 collides against the rectifier 105 and spreads in a direction parallel to the rectifier 105, and in the turbulent flow zone, the air may be stagnated within the upstream space 107 of the rectifier, and the movement of dust may be slow. As described, the dust 123 moves in a direction parallel to the rectifier 105 within the upstream space 107 of the rectifier. However, the dust 123 once discharged from the rectifier 105 floats along the blown air 106 of the laminar flow in one direction, such that the movement of the dust in the direction orthogonal to the air flow direction is limited, approximately caused by diffusion.

The probability of collecting dust 123 during measurement of the amount of dust in the space becomes significantly higher when air is sampled in the upstream space 107 of the rectifier in the turbulent flow zone accompanying the movement of the dust 123, compared to the air within the workspace 104 having a laminar flow. In evaluating the amount of dust within the workspace 104, if the air within the workspace 104 is sampled directly, dust may be overlooked if sampling is not performed at a number of different locations. However, in the upstream space 107 of the rectifier serving as a turbulent flow zone, the probability of collecting dust is high, even if there is only a small number of different sampling locations. According to the first embodiment, at least one suction port 119 is provided in the upstream space 107 of the rectifier, and the air of the turbulent flow zone in the upstream space 107 of the rectifier can be sampled from the suction port 119. Thus, the dust 123 leaked from the HEPA filter 103 can be caught without fail.

Figure 3:
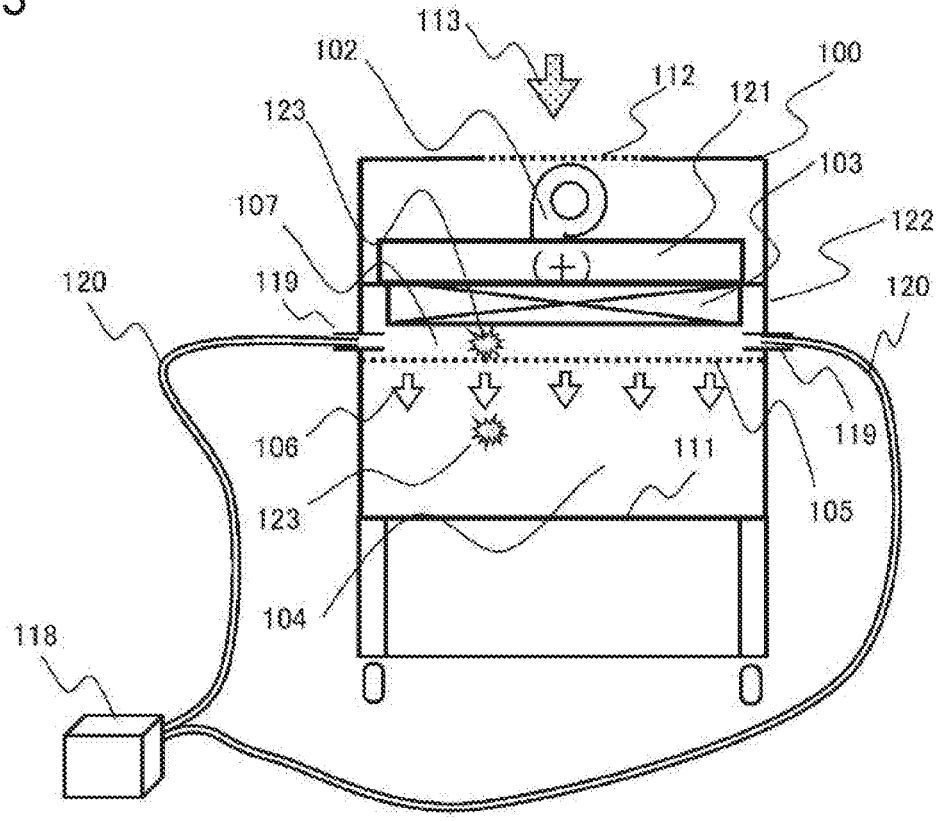
FIG. 3 illustrates an example of a cross-sectional view of the clean work station and a dust measuring method according to the first embodiment of the present invention.

FIG. 3 illustrates an example of executing a dust measuring method with respect to the cross-sectional front view of a clean work station according to the first embodiment illustrated in FIG. 2.

The suction port 119 communicating the upstream space 107 of the rectifier and the exterior of the clean work station 100 is disposed on the wall surface of a main body case 122, to take samples of the air in the turbulent flow zone of the upstream space 107 of the rectifier. The suction port 119 can be disposed at an arbitrary position on the wall surface on both sides or on the wall surface at the rear side of the main body case 122, and there can be a plurality of suction ports 119 (FIGS. 1 and 2). The shape of the suction port 119 can be round or square.

In order to measure dust using the suction port 119, one end of a sampling tube 120 is inserted to the suction port 119, and the other end of the sampling tube 120 is connected to a dust measuring device 118. A light scattering type airborne particle counter (particle counter) or a relative densitometer (photometer) is used as the dust measuring device 118. If there are a plurality of suction ports 119, it is possible to insert the sampling tube 120 to each of the suction ports 119, collectively connect the tubes to the dust measuring device 118, and collectively take the sampled air into the dust measuring device 118. The dust measuring device 118 sucks in a fixed amount of air per unit time for measurement, so that the amount of air taken into the dust measuring device 118 is the same, regardless of whether the air is sampled from one location or from a plurality of locations. Then, in an environment where there is only a small amount of dust from the beginning, leakage of sampling can be reduced by performing sampling for a plurality of times at one location. On the other hand, in an environment where a certain amount of dust is assumed, measurement can be completed by a smaller number of sampling by taking the samples at a plurality of locations.

As described earlier, in measuring the amount of dust in a space, the probability of collecting duct in a turbulent flow zone where movement of dust occurs is extremely high compared to a laminar flow zone, so that as illustrated in FIG. 3, the dust measuring device 118 takes in air from the suction port 119 arranged on the upstream space 107 of the rectifier, which is a turbulent flow zone. Thus, the possibility of sampling dust leaked from the HEPA filter 103 using the dust measuring device 118 becomes extremely high.

There is a case where the dust measuring device 118 and the sampling tube 120 are constantly connected to the clean work station 100 and the dust concentration during state of use is monitored, and a case where the dust is measured by removing a lid (not shown) of the suction port 119 and connecting the dust measuring device 118 and the sampling tube 120 to the clean work station 100 periodically to test whether there is a leak in the HEPA filter 103. The total amount of dust flowing in the upstream space 107 of the rectifier is the same as the total amount of dust in the air flowing in the workspace 104, so that checking the state of the amount of dust per unit volume on the upstream side is the same as checking the state of the amount of dust per unit time on the downstream side.

In the first embodiment, an example has been illustrated where the air flow within the workspace 104 is a laminar flow in the vertical direction, but the positional relationship between the HEPA filter and the rectifier is the same even in a case where the laminar flow is in the horizontal direction. In this description, the horizontal direction refers to the direction corresponding to a right angle in a direction perpendicular to the horizontal direction, but it is not strictly limited to the horizontal direction.

A configuration of the clean work station 100 has been illustrated as the first embodiment, but obviously, the first embodiment can be adopted in a configuration of a safety cabinet.

Second Embodiment

Figure 4A:
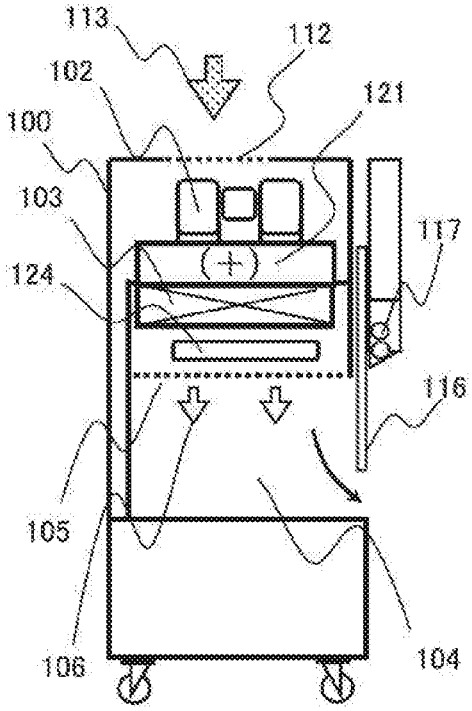
FIG. 4A illustrates an example of a cross-sectional side view of a clean work station according to a second embodiment of the present invention.
Figure 4B:
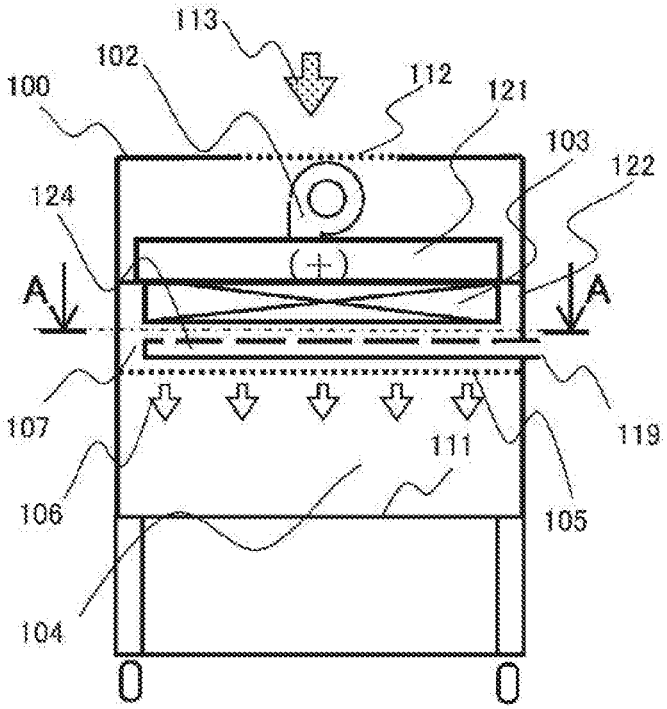
FIG. 4B illustrates an example of an external front view of the clean work station according to the second embodiment of the present invention.

FIG. 4 illustrates a configuration of the clean work station 100 according to a second embodiment, wherein FIG. 4A illustrates an example of a cross-sectional side view, and FIG. 4B illustrates an example of a cross-sectional side view thereof. The descriptions regarding the portions having a same function as the configurations assigned with the same reference numbers as those described with reference to FIGS. 1 through 3 are omitted.

Figure 5:
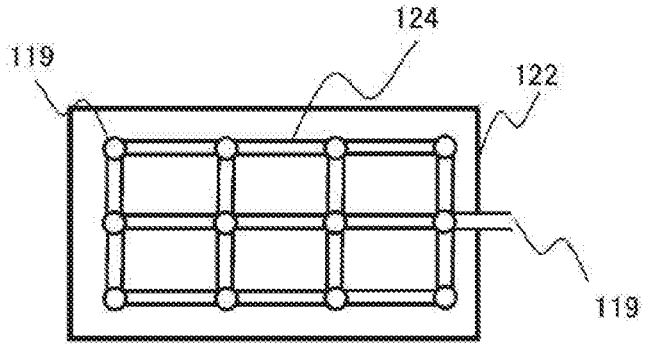
FIG. 5 illustrates an example of a cross-sectional view of the clean work station according to the second embodiment of the present invention.

In the second embodiment, in addition to the first embodiment described above, a lattice shaped measurement port 124 is arranged in an upper side space 107 of the rectifier. FIG. 5 illustrates a configuration example of the lattice shaped measurement port 124, illustrating a cross-section AA of FIG. 4B from above. A plurality of suction ports 119 are arranged in the lattice shaped measurement port 124, and the air taken in through the plurality of suction ports 119 is gathered at the exit of the main body case 122, and communicated with the suction port 199 through which the air is drawn out to the exterior of the apparatus.

The lattice shaped measurement port 124 is arranged to face the HEPA filter 103, such that even if dust leaks from any location on the air blow out surface of the HEPA filter 103, the dust can be caught infallibly by any one of the plurality of suction ports 119 arranged in a lattice shape, and leakage of dust can be sampled reliably. Moreover, the arrangement of the suction ports 119 is not restricted to a lattice shape, and it can be other shapes, such as a linear shape or a spiral shape.

As for the arrangement position of the lattice shaped measurement port 124, it is preferable to provide the port in the turbulent flow zone, as described earlier, so that it is effective to arrange the measurement port 124 in the upper side space 107 of the rectifier. As for the actual arrangement position, it should preferably be arranged directly below the HEPA filter 103 and directly above the rectifier 105, and arranged around a center in a height direction of the upper side space 107 of the rectifier with the suction port positioned upward. The reliability of capturing dust is increased by setting the planar size of the lattice shaped measurement port 124 to have an approximately equivalent size as the HEPA filter 103.

Further, the method for connecting with the dust measuring device 118 and the sampling tube 120 is the same as FIG. 3 described with reference to the first embodiment.

Further, the second embodiment has been illustrated as a configuration of the clean work station 100, but obviously, it can also be applied to a configuration of a safety cabinet.

Third Embodiment

Figure 6:
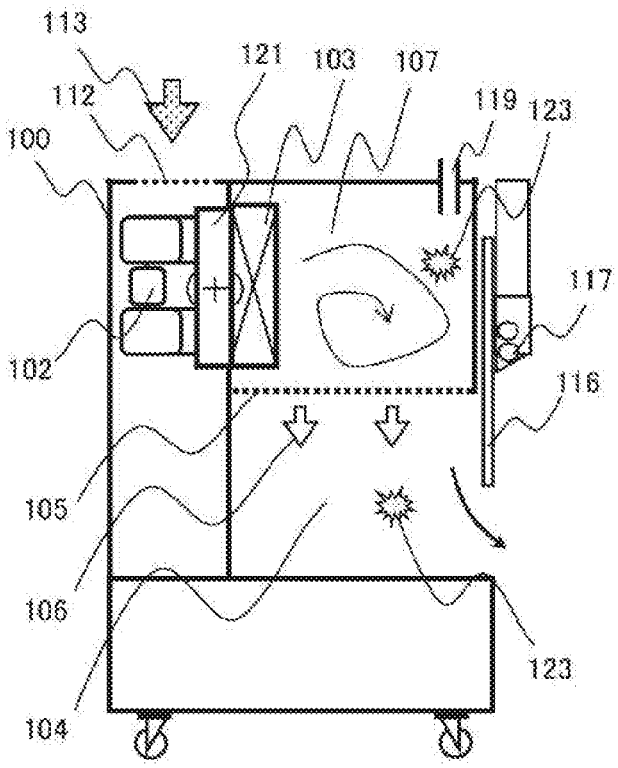
FIG. 6 illustrates an example of a cross-sectional side view of a clean work station according to a third embodiment of the present invention.

FIG. 6 illustrates a cross-sectional side view of a clean work station 100 according to a third embodiment. The descriptions of components having the same reference numbers and same functions as those described in FIGS. 1 through 3 are omitted.

With reference to the first embodiment, the present embodiment arranges the HEPA filter 103 and the rectifier 105 at right angles. In the present embodiment, what is meant by the HEPA filter 103 and the rectifier 105 being arranged at right angles is that the angle formed by the HEPA filter 103 and the rectifier 105 is approximately 90 degrees, not strictly restricted to 90 degrees. As described, by relatively arranging the HEPA filter 103 and the rectifier 105 at right angles, the course of air flow from the HEPA filter 103 to the rectifier 105 can be changed, and more turbulent flow can be created. Thus, the air blowing out from the HEPA filter 103 is further diffused before it passes the rectifier 105. Even if there is a leakage of dust (leak) in the HEPA filter 103 and dust is leaked therefrom, the possibility of the leaked dust existing near the suction port 119 is high in a state where the air within the upper side space 107 of the rectifier is diffused. The positional relationship between the HEPA filter 103 and the rectifier 105 is not restricted to right angles, and the positional relationship can be angles other than the right angle, or in parallel but without the blow out surface of the HEPA filter 103 facing the rectifier 105. That is, the relative angle of the HEPA filter 103 and the rectifier 105 can be set to 0 degrees or greater and smaller than 180 degrees.

The method for connecting the dust measuring device 118 and the sampling tube 120 is the same as FIG. 3 illustrating the first embodiment.

Further, the third embodiment has been illustrated as a configuration of the clean work station 100, but obviously, it can also be applied to a configuration of a safety cabinet.

Fourth Embodiment

Figure 7A:
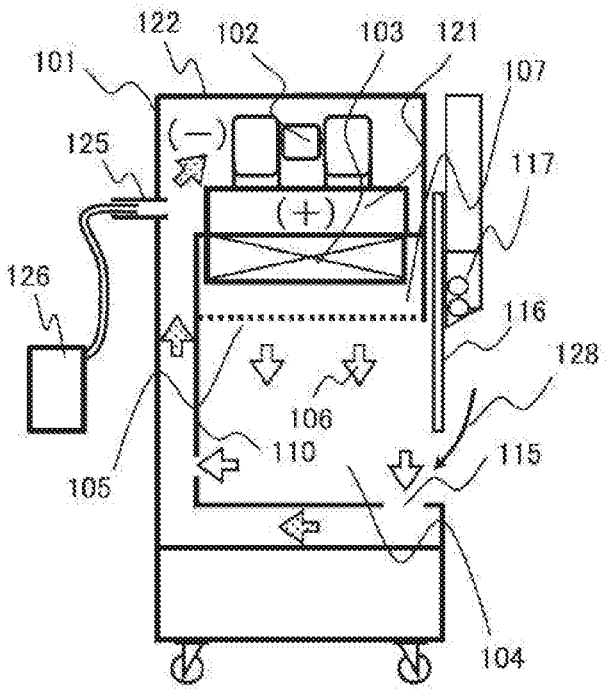
FIG. 7A illustrates an example of a cross-sectional side view of a safety cabinet according to a fourth embodiment of the present invention.
Figure 7B:
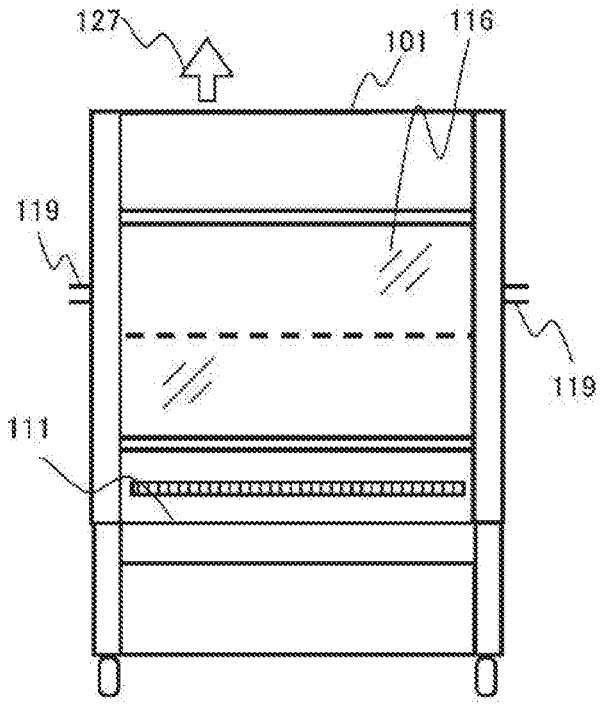
FIG. 7B illustrates an example of an external front view of the safety cabinet according to the fourth embodiment of the present invention.
Figure 8:
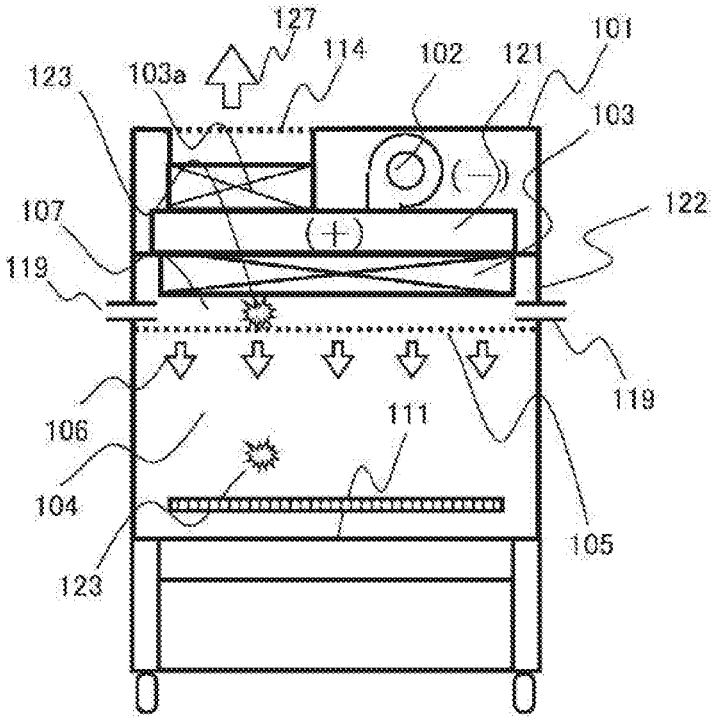
FIG. 8 illustrates an example of a cross-sectional view of the safety cabinet according to the fourth embodiment of the present invention.

FIG. 7 illustrates a cross-sectional side view of a safety cabinet 101 according to a fourth embodiment, wherein FIG. 7A illustrates an example of a cross-sectional side view thereof, and FIG. 7B illustrates an external front view thereof. FIG. 8 illustrates an example of a cross-sectional front view of the safety cabinet 101. The descriptions of components having the same reference numbers and same functions as those described in FIGS. 1 through 3 are omitted.

A portion of the clean air device and the safety cabinet are configured as illustrated in the fourth embodiment.

The positional relationship of the air blower 102, the pressurization chamber 121, the HEPA filter 103, the upper side space 107 of the rectifier and the rectifier 105 is the same as the first embodiment.

A HEPA filter 103*a* for discharging air is provided at a location different from the HEPA filter 103 communicated with the pressurization chamber 121 (FIG. 8). The air blowing out from the air blower 102 pressurizes the pressurization chamber 121, and blows out through the HEPA filter 103 communicated with the pressurization chamber 121, and through the HEPA filter 103*a* for discharging air.

A suction grill 115 is formed on a workbench surface 111 under the front face shutter 116. The air 106 blown into the workspace 104 is sucked in from the suction grill 115, travels under the workbench surface 111 and behind the rear wall surface 110 of the workspace, and sucked into an air blower 2. The air blown into the air blower 2 pressurizes the pressurization chamber 121. According to the configuration of air flow described above, the amount of air sucked in from the suction grill 115 below the front face shutter 116 is equal to the amount of air blown through the HEPA filter 103*a* for discharging air to the exterior.

The intake of air into and discharge of air out of the safety cabinet 101 are performed as described earlier. The amount of air blowing into the workspace 104 as a portion of air having entered the pressurization chamber 121 mixes with the air sucked in through the suction grill 115 from the exterior of the safety cabinet 101, and supplied to the workspace 104 again. As described, the same air is circulated as a portion of the air supplied to the workspace 104.

Even in a state where a portion of the air is circulated, the upstream space 107 of the rectifier is still an enclosed space where the blow out side of the HEPA filter 103 is positioned upstream and the rectifier 105 is positioned downstream. The workspace 104 is also an enclosed space where the output side of the rectifier 105 is positioned upstream and the suction grill 115 below the front face shutter 116 is positioned downstream. If no dust is newly generated within the workspace 104, a certain amount of air is moved, but the amounts of dust per unit time within the upstream space 107 of the rectifier and within the workspace 104 are the same.

Even in a case where the air within the workspace 104 having dust removed is circulated, or in a case as according to the first embodiment where air is sucked in from the exterior of the device, the amount of dust leaked through the HEPA filter 103 is small in an environment where a clean work station is arranged in a clean room and the amount of dust in the air is small. In that case, even if a phenomenon occurs where the HEPA filter 103 is damaged and dust leaks out, since the original amount of dust is small, it is difficult to discover leakage of dust in the dust measuring device 118, and the possibility of finding leakage of dust is very little.

That is to say, in order to discover leakage of duct in an environmental condition within a cleanroom, the simple use of a dust measuring device is not sufficient, and it is necessary to take measures such as intentionally injecting a minimum necessary amount of object corresponding to dust to discover the leakage of dust.

Therefore, in the fourth embodiment, a simulated dust charging port 125 is provided independently from the suction port 119 on the main body case 122 of the safety cabinet 101. The simulated dust charging port 125 on an inner side of the main body case 122 is a negative pressure space at an intake side of the air blower 102 (space marked "(−)" in FIG. 7A). The dust generated from a simulated dust generator 126 is connected to the simulated dust charging port 125, and simulated dust is supplied to an upstream side of the HEPA filter 103. In that case, simulated dust of approximately 10 to 100 μg/liter is generated and supplied. Since the concentration of dust upstream of the HEPA filter 103 is higher than before the simulated dust is fed, the concentration of dust after being blown out from the HEPA filter 103 is also high. In this state, measurement is executed in the manner described earlier using the dust measuring device. Thereby, leaks caused for example by the damaging of the HEPA filter 1 can be discovered. The simulated dust being used can be sprayed oil, smoke from an incense stick, and so on.

As for the generation timing of the simulated dust, there is no need to generate dust regularly, and the dust may only be generated when the concentration of dust within the workspace 104 is monitored.

In order to provide the simulated dust charging port to the clean work station 100 of the first to third embodiments, a simulated dust charging port communicated with the exterior of the apparatus should be provided on a wall surface of the main body case of the clean work station 100 opposed to the space starting from the inlet port 112 formed on the clean work station 100 to an intake side of the air blower 102, that is, to the negative pressure space (for example, which is the position of the simulated dust charging port (125) illustrated by the dotted line in the first embodiment of FIG. 1).

Next, we will describe the method for measuring dust using the dust measuring device 118 by supplying simulated dust from the simulated dust generator 126 and discovering leaks caused for example by the damaging of the HEPA filter 103. In this case, the simulated dust generator 126 is connected to the simulated dust charging port 125 and the dust measuring device 118 is connected to the suction port 119, and the operation of supplying simulated dust from the simulated dust generator 126 and the operation of measuring dust by the dust measuring device 118 are performed approximately simultaneously. Thus leakage of dust can be discovered even in an environment where the original amount of dust is little.

Moreover, even if the supplying of dust and measurement are not performed approximately simultaneously, dust can be measured by the dust measuring device 118 after continuously supplying simulated dust and in a state where a certain amount of dust exists within the workspace.

In that case, a certain amount of dust exists in the workspace, so that the amount of dust per unit time becomes substantially fixed even in a case where measurement is performed for a number of times at the same measurement location by the dust measuring device 118. Thus, it becomes possible to confirm whether the dust measuring device 118 is showing a correct value.

If dust measurement is performed for a number of times at each of the respective measurement locations, close values can be measured at the respective measurement locations, so that even if there are operational errors of tests or influence of noises, the accuracy of the test can be improved.

REFERENCE SIGNS LIST

100 Clean work station
101 Safety cabinet

102 Air blower
103 HEPA filter
103*a* HEPA filter for discharge
104 Interior of workroom
105 Rectifier
106 Blown air
107 Upstream side space of rectifier
108 Inner wall surface of workroom
109 Front face of workroom
110 Rear wall surface of workroom
111 Surface of workbench
112 Suction port
113 Sucked air
114 Discharge port
115 Suction grill
116 Front face shutter
117 Illuminating light
118 Dust measuring device
119 Suction port
120 Sampling tube
121 Pressurization chamber
122 Main body case
123 Dust
124 Lattice shape measurement port
125 Simulated dust charging port
126 Simulated dust generator
127 Discharged air
128 Flow-in air

The invention claimed is:

1. A clean air device comprising:

an air cleaning unit;

a rectifying unit arranged downstream of the air cleaning unit configured to rectify air blown from the air cleaning unit and form a laminar flow; and a workroom arranged downstream of the rectifying unit, wherein at least one suction port is provided on a wall surface in a space that is physically located between the air cleaning unit and the rectifying unit, configured to draw out the air in the space to an exterior, at least one of the suction ports provided on the wall surface is connected to a dust measuring device to measure dust in an air within the space by the dust measuring device, a charging port communicated with an exterior is provided on the wall surface of the clean air device forming the space on an upstream side of the air cleaning unit, and the charging port is connected to a simulated dust generator, such that simulated dust is supplied from the simulated dust generator to the space on the upstream side of the air cleaning unit.

2. The clean air device according to claim 1, wherein a measurement port comprising the at least one suction port arranged in a lattice shape, a spiral shape or a linear shape is provided within the space, and the measurement port is connected from an inner side of the wall surface to the suction port provided on the wall surface.

3. The clean air device according to claim 1, wherein a relative angle formed between a blowout surface of the air cleaning unit and the rectifying unit opposed thereto is 0 degrees or greater and smaller than 180 degrees.

4. The clean air device according to claim 1, wherein the clean air device is a clean work station.

5. The clean air device according to claim 1, wherein the clean air device is a safety cabinet.

6. An air cleaning unit inspecting method of a clean air device comprising an air cleaning unit, a rectifying unit arranged downstream of the air cleaning unit configured to rectify air blown from the air cleaning unit and form a laminar flow, and a workroom arranged downstream of the rectifying unit, the method comprising:

connecting a dust measuring device to at least one suction port provided on a wall surface of a space that is physically located between the air cleaning unit and the rectifying unit;

sucking air within the space formed between the air cleaning unit and the rectifying unit by the dust measuring device, and measuring dust contained in the air;

connecting a simulated dust generator to a charging port provided on the wall surface of the space formed upstream of the air cleaning unit; and executing an operation to supply the simulated dust to the space formed upstream of the air cleaning unit by the simulated dust generator, and an operation to measure the dust by the dust measuring device.

* * * * *